United States Patent [19]

Kley

[11] 4,425,012

[45] Jan. 10, 1984

[54] ROLL TOWEL DISPENSER MOUNTING BRACKETS

[75] Inventor: Richard D. Kley, New Castle County, Del.

[73] Assignee: Scott Paper Company, Philadelphia, Pa.

[21] Appl. No.: 246,586

[22] Filed: Mar. 23, 1981

[51] Int. Cl.[3] ..... B60N 19/00

[52] U.S. Cl. ..... 312/37; 211/105.3; 248/205 R; 248/205 A; 312/245

[58] Field of Search ..... 248/225.3 A, 205.3, 248/205.4, 214, 57, 231.2, 213.4; 312/37, 38, 245, 242; 211/105.3; 52/242, 289, 702

[56] References Cited

U.S. PATENT DOCUMENTS

| | | | |
|---|---|---|---|
| Re. 18,726 | 1/1933 | O'Brien | 312/38 |
| D. 176,703 | 1/1956 | Snivley . | |
| 2,518,328 | 8/1950 | Janonis . | |
| 2,632,684 | 3/1953 | Anderson | 312/245 |
| 2,673,693 | 3/1954 | Gray . | |
| 2,679,373 | 5/1954 | Henley | 248/205.4 |
| 2,743,023 | 4/1956 | Larson . | |
| 2,920,853 | 1/1960 | Bufogle | 248/214 |
| 2,925,916 | 2/1960 | Pollock | 248/214 X |
| 3,147,051 | 9/1964 | Birr et al. | 312/37 |
| 3,168,275 | 2/1965 | Grondin . | |
| 3,207,566 | 9/1965 | Grieco et al. | 248/205.3 |
| 3,260,559 | 7/1966 | Newman et al. | 312/245 X |
| 3,599,918 | 8/1971 | Patchett | 248/205.3 |
| 3,616,096 | 10/1971 | Roeder | 248/205.3 |
| 3,637,274 | 1/1972 | Manuel | 312/38 |
| 3,733,044 | 5/1973 | Rabner | 248/313 |
| 4,111,309 | 5/1978 | Henry | 211/105.3 X |
| 4,165,851 | 8/1979 | Bowden, Jr. et al. | 248/57 |
| 4,366,774 | 1/1983 | Haake et al. | 211/105.3 |

FOREIGN PATENT DOCUMENTS

| | | | |
|---|---|---|---|
| 212730 | 2/1958 | Australia | 248/213.4 |

*Primary Examiner*—James T. McCall

*Attorney, Agent, or Firm*—Joseph H. Yamaoka; J. W. Kane, Jr.

[57] ABSTRACT

Apparatus for mounting a roll towel dispenser (30) on the door (12) of a recessed paper towel cabinet (10). The apparatus includes a bracket assembly (40) that has a hooked end portion (54) adapted to fit over the top edge of the door (12) of the recessed cabinet (10). The bracket assembly (40) is secured by means of nuts (56) and bolts (50) to the rear wall of the roll towel dispenser (30). The bracket assembly (40) is also adhered to the front surface of the door (12) of the recessed cabinet (10) in order to stabilize, or prevent relative motion between the assembly comprising the bracket (40) and roll towel dispenser (30) and the door (12). In one aspect of the invention, the bracket (40) is formed so that when it is assembled to the door (12) of the recessed towel cabinet (10), a portion (42) of the bracket plate (40) is spaced apart from the surface of the door (2) of the recessed cabinet (10) so that it clears the projecting portion of a lock assembly (34). In another aspect of the invention, when the lower portion of the roll towel dispenser (30) extends below the cabinet section of the recessed unit (10), there is provided an additional support bracket (84) that can be secured to the rear wall of the roll towel dispenser (30) and to an inner wall (18, 20, 22) of the recessed unit (10) in order to provide additional support for the lower section of the roll towel dispenser (30).

9 Claims, 5 Drawing Figures

ROLL TOWEL DISPENSER MOUNTING BRACKETS

TECHNICAL FIELD

This invention relates to the mounting of a roll towel dispenser onto the door of a recessed cabinet. More particularly, the invention is directed to bracket assemblies that can be fastened to the roll towel dispenser and which can be used to hang the roll towel dispenser on the door of the recessed cabinet. The bracket assemblies include means for stabilizing and supporting the bracket and dispenser assembly on the door of the recessed cabinet.

BACKGROUND ART

Many public washrooms have one or more recessed towel dispenser/waste receptacle units, made of stainless steel, built into the walls. The upper section of the recessed unit houses a towel dispenser cabinet capable of holding a large supply of folded paper towels. Typically, the towel dispenser unit has a front door which is capable of being locked. The lower section of the recessed unit houses a removable waste receptacle into which used paper towels can be deposited. A central portion of the recessed unit, between the bottom of the towel dispenser and the top of the waste receptacle, is recessed to make it convenient for patrons to deposit used paper towels into the waste receptacle.

Some owners of recessed folded towel dispenser units desire to have a roll towel dispenser to either supplement or replace the supply of folded towels. If the roll towel dispenser is being used to replace the source of folded towels, it would be very convenient to mount the roll towel dispenser over the door of the folded towel cabinet section of the recessed unit. While these roll towel dispensers are typically designed to be fastened to a wall by means of screws, the owner of a recessed unit is reluctant to drill holes into the door of the recessed folded towel cabinet to accommodate either screws or bolts for fastening the roll towel dispenser to the door of the recessed wall cabinet. Two reasons for that reluctance are: (1) if it is later desired to remove the roll towel dispenser and return to using folded towels, unsightly holes would remain in the cabinet door of the recessed unit; and, (2) drilling holes in the door of the recessed cabinet may leave burrs in the inside surface of the door which may tear or impede the flow of folded towels down through the interior of the folded towel cabinet. Thus, it is very desirable to mount the roll towel dispenser on the door of the recessed folded towel cabinet by means that will not require holes in the door of the recessed unit.

Although it would be possible to use an adhesive to bond the rear panel of the roll towel dispenser to the door of the recessed folded towel cabinet, the possibility that the adhesive might fail would preclude use of an adhesive as the sole means for supporting the roll towel dispenser.

It is known in the prior art to use a bracket which has a hooked end portion that can fit over the top of a wall and which does not require screws of bolts to secure the bracket to the wall as the sole means for mounting or supporting articles. For example, U.S. Pat. Nos. 2,518,328-Janonis and 2,673,693-Gray both disclose holders for a roll of bathroom tissue in which the holder has a hooked end portion that fits over the top edge of a wall of a water closet flushing tank. U.S. Design Pat. No. 176,703-Snively discloses a holder for a bathroom tissue roll in which the holder has a hooked end portion which is suitable for being placed over the top edge of a wall member. U.S. Pat. No. 2,743,023-Larson discloses a clothes hanger which is secured to a bracket which has a hooked end portion that clamps over the top edge of a door. The Larson patent also discloses that the bracket can be secured to the door by means of screws as shown in FIGS. 7, 8, and 9. It is not desirable to use a bracket with a hooked end portion as the sole means for securing a roll towel dispenser, which when fully loaded weighs approximately 11 lbs., to the door of a recessed folded towel cabinet. For example, when the bracket and roll towel dispenser cabinet is installed and is in normal use, because of the rather large lever arm from the bottom of the roll towel dispenser to the hooked portion of the bracket, pulling forward on the bottom of the roll towel dispenser can cause the bracket to bend out of its normal shape and to possibly present an unsafe condition when the door of the recessed cabinet is opened. Therefore, it has been found to be desirable to stablize or prevent relative motion of the bracket and roll towel dispenser cabinet assembly with respect to the door. The stabilizing means also promotes a safe installation by preventing the bracket and roll towel dispenser assembly from sliding off of the door of the recessed unit.

U.S. Pat. Nos. 3,168,275-Grondin and 3,733,044-Rabner both disclose holders for boxes of facial tissues in which pressure sensitive adhesive is the sole means of securing the holder to a wall. While pressure sensitive adhesive material can adequately support a relatively lightweight holder and package such as a box of facial tissues, it would not be adequate as the sole means of support for a roll towel dispenser which typically weighs about 11 lbs. and which on occasion is subjected to abuse.

DISCLOSURE OF THE INVENTION

In accordance with this invention, there is provided apparatus for mounting a roll towel dispenser on the door of a recessed paper towel cabinet. The apparatus includes a bracket plate that has a hooked end portion adapted to fit over the edge of the door of the recessed cabinet. The bracket plate can be secured, for example, by means of nuts and bolts to the rear wall of the roll towel dispenser. The bracket is also adhered to the front surface of the door of the recessed cabinet in order to stabilize, or prevent relative motion between the assembly comprising the bracket and roll towel dispenser and the door. In one embodiment, the bracket is formed so that when it is assembled to the door of the recessed towel cabinet, a portion of the bracket plate is spaced apart from the surface of the door of the recessed cabinet so that it clears the projecting portion of a lock assembly.

In another embodiment, the bracket plate is adjustable so that the height of the roll towel dispenser can be varied.

In certain instances, when the lower portion of the roll towel dispenser extends below the cabinet section of the recessed unit, there is provided an additional support bracket that can be secured to the rear wall of the roll towel dispenser and to an inner wall of the recessed unit in order to provide additional support for the lower section of the roll towel dispenser.

BRIEF DESCRIPTION OF THE DRAWINGS

While the specification concludes with claims particularly pointing out and distinctly claiming that which is regarded as the present invention, the objects the advantages of this invention can be more readily ascertained from the following description of a preferred embodiment when read in conjunction with the accompanying drawings in which:

BEST MODE FOR CARRYING OUT THE INVENTION

Figure 1:
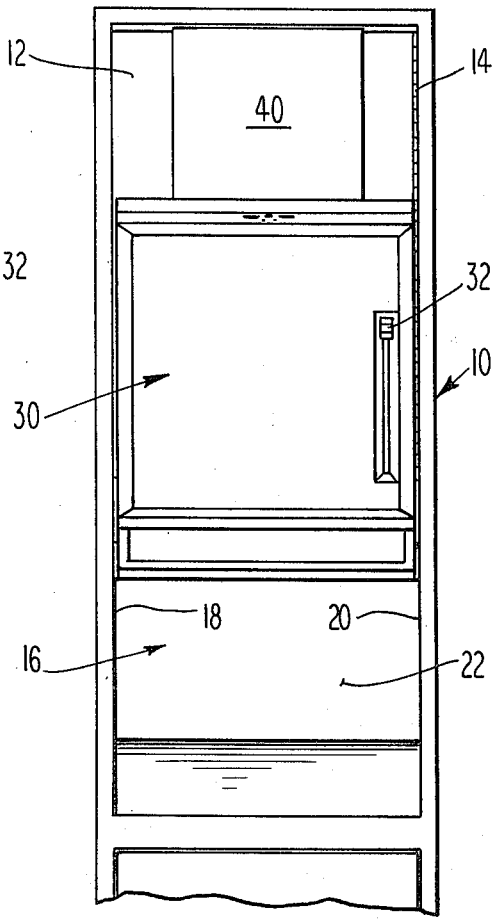
FIG. 1 is a front elevation showing a roll towel dispenser mounted on the door of a recessed cabinet using the mounting bracket of the invention.

For the sake of convenience, an element that is depicted in more than one figure will retain the same element number in each figure. FIG. 1 shows a lever operated roll towel dispenser 30 that is mounted on the door 12 of a recessed towel dispenser/waste receptacle unit 10. Typically, the recessed towel dispenser/waste receptacle unit 10 is built into the wall of a public washroom. The upper section of the recessed unit 10 houses a folded paper towel cabinet, only the door 12 and hinge 14 being visible in FIG. 1. The lower section 24 of the recessed unit 10 is used to store a waste receptacle (not shown). The central recessed section 16 of the unit 10 separates the folded towel cabinet section of the unit 10 from the lower, waste receptacle storage section 24 of the unit 10. The roll towel dispenser 30 is mounted onto the front door 12 of the recessed unit 10 by means of a bracket assembly 40.

Figure 2:
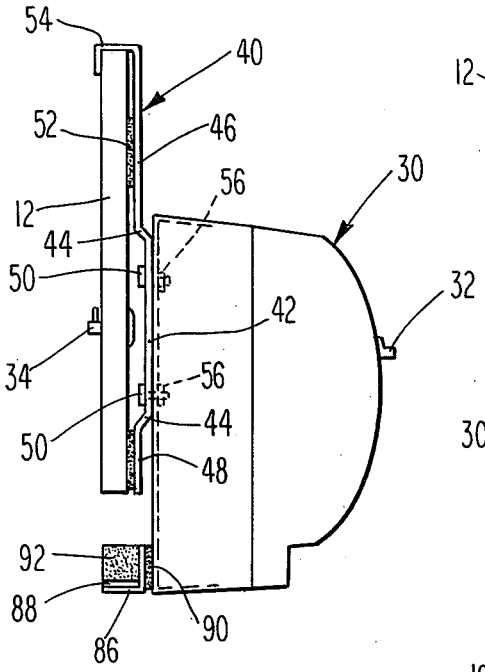
FIG. 2 is a side elevation showing both a mounting bracket and a lower support bracket secured to the roll towel dispenser.
Figure 3:
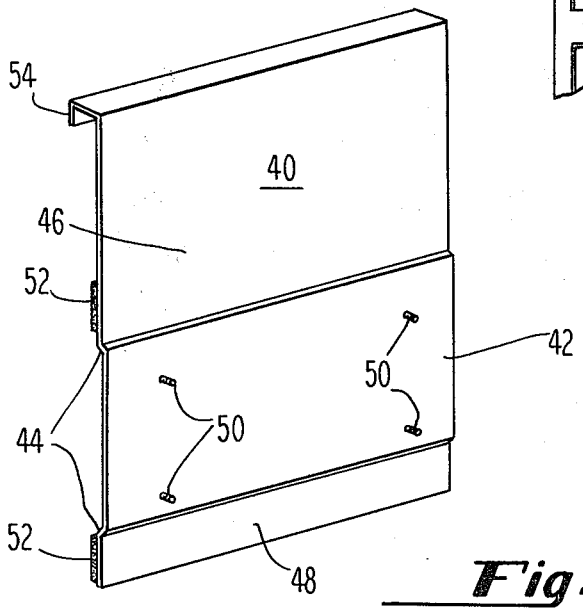
FIG. 3 is an isometric view of one embodiment of a mounting bracket.

As shown in FIGS. 2 and 3, the bracket 40 has a hooked end portion 54 that fits over the top of the door 12 of the recessed unit 10 and which contacts the top surface and the rear surface of the door 12. The bracket 40 includes angled portions 44 which divide the bracket 40 into a central section 42 that is spaced further away from the front surface of door 12 than either the upper section 46 or the lower section 48. The reason for the spacing of the central section 42 of the bracket 40 is to provide clearance for mounting hardware such as bolts 50 for securing the roll towel dispenser 30 to the mounting section 42 of the bracket 40, and to provide clearance for any portion of lock assembly 34 that might protrude from the front surface of the door 12. The roll towel dispenser 30 is secured to the central mounting section 42 of bracket assembly 40 by means of bolts 50 and nuts 56. In the preferred embodiment, bolts 50 are weld bolts that are permanently welded to the central mounting section 42 of bracket 40.

Although it is possible to mount the roll towel dispenser 30 on the door 12 solely by means of the bracket assembly 40, it is desirable for several reasons to stabilize or prevent relative movement of the bracket assembly 40 with respect to the door 12. For example, if the bracket is free to move with respect to the door 12, a person assemblying the roll towel dispenser 30 and bracket 40 onto the door 12 may accidentally hit the roll towel dispenser 30 and cause the assembly to slide off the door 12. Also, if a person should intentionally pull forward on the bottom of the roll towel dispenser 30, because of the large lever arm from the bottom of the roll dispenser 30 to the hooked end portion 54 of the bracket assembly 40, the bracket 40 can be easily bent. For those reasons it has been found necessary to provide adhesive means 52 for securing the bracket 40 to the front surface of the door 12. This adhesive 52 stabilizes or prevents relative movement of the bracket 40 with respect to the door 12. In the preferred embodiment, the adhesive means 52 is two sided pressure-sensitive tape that is applied between the upper section 46 of bracket assembly 40 and the door 12 and between the lower section 48 of the bracket assembly 40 and the door 12.

Figure 4:
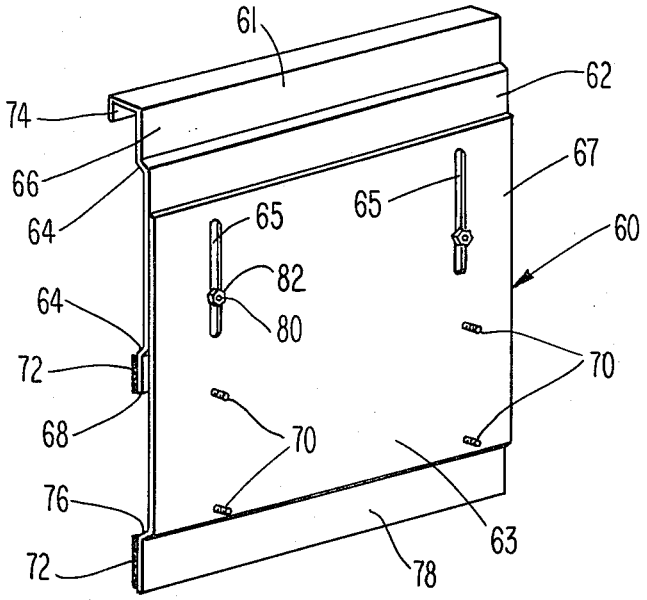
FIG. 4 is an isometric view of a mounting bracket that is adjustable in height.

Referring now to FIG. 4, there is shown an alternate embodiment of a bracket assembly 60 for mounting a roll towel dispenser 30 to the door 12 of a recessed unit 10. The bracket assembly 60 includes an upper bracket member 61 and a lower bracket member 63 having vertically oriented slots 65 which allow the height of the lower bracket member 63 to be adjusted with respect to the upper bracket member 61. The upper bracket member 61 has a hooked end portion 74 which fits over the top of the door 12 of the recessed unit 10. The upper bracket member 61 has two angled portions 64 which divide it into an upper flat section 66 and a lower flat section 68 separated by a central section 62 that is spaced further from the front surface of the door 12 than either the upper or lower flat section 66, 68 when the bracket 60 is mounted on the door 12. The lower bracket member 63 includes an angled portion 76 which divides it into a lower flat section 78 and an upper mounting surface section 67. Two bolts 80, preferrably weld bolts welded to the central section 62 of the upper bracket member 61 and located in alignment with the vertical slots 65 in the mounting surface 67 of the lower bracket member 63 allow adjustment of the height of the mounted roll towel dispenser 30. The mounting surface 67 of the lower bracket member 63 includes bolts 70, preferrably weld bolts. The rear panel of the roll towel dispenser 30 can be secured to the mounting surface 67 by means of the weld bolts 70. Adhesive means such as two sided pressure-sensitive adhesive tape 72 is applied to the lower flat section 78 of the lower bracket member 63 and to the lower flat section 68 of the upper bracket member 61. When the bracket assembly 60 with the roll towel dispenser 30 mounted thereon is placed on the door 12 of the dispenser unit 10, the two sided pressure-sensitive adhesive tape 72 stabilizes or prevents any relative movement of the bracket and roll towel dispenser assembly 60 with respect to the door 12.

Figure 5:
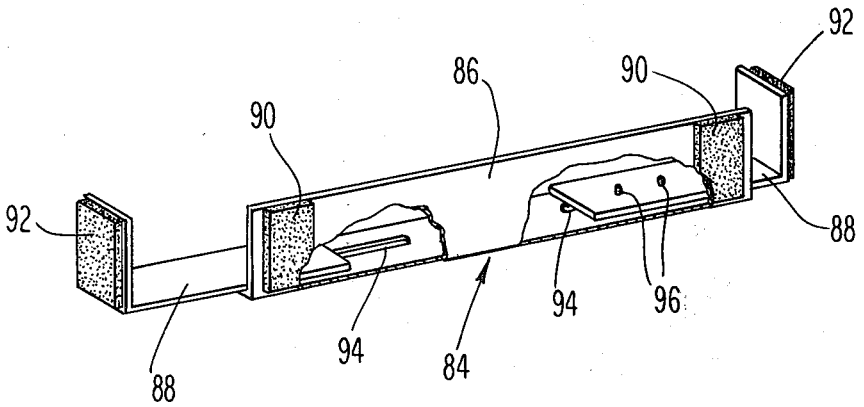
FIG. 5 is an isometric view of one embodiment of a lower support bracket.

The lower portion of the roll towel dispenser 30 can, as shown in FIGS. 1 and 2, extend below the door 12 of the folded towel cabinet section of the recessed unit 10. When a user of the roll towel dispenser 30 causes toweling to be dispensed by depressing the lever 32, there may either be some slight inward movement of the bottom of the roll towel dispenser 30 or some slight side movement of the bottom of the dispenser cabinet 30 due to lack of support. In those cases it may be desirable to supply a lower support bracket assembly 84 which is depicted in FIGS. 2 and 5. As shown in FIG. 5, the lower support bracket 84 includes an angled body support bracket 86 and two L-shaped end brackets 88. The horizontal leg of the angled bracket 86 has two slots 94 oriented as shown. Self threading screws 96 passing through slots 94 and holes in the horizontal leg of the L-shaped end brackets 88 allow for adjustment of the extension of brackets 88. Two sided pressure-sensitive adhesive tape is applied to the vertical leg of each L-shaped end bracket 88 and to the vertical leg of the angled body support bracket 86.

As shown in FIG. 2, the angled shaped body support bracket 86 is secured by means of pressure-sensitive adhesive tape 90 to the lower portion of the rear wall of the roll towel dispenser 30. The two L-shaped end brackets 88 are adjusted so that the short leg of the L-shaped end brackets 88 are adhered to the inner side walls 18, 20 of the recess 16 of FIG. 1. Screws 96 can then be tightened to secure the L-shaped end brackets 88. The lower bracket assembly 84 resists any tendency of the lower portion of the roll towel dispenser 30 to move into the recess 16 and also resists any side-to-side motion of the lower portion of roll towel dispenser 30. It will be understood by those skilled in the art that although the preferred embodiment of lower bracket assembly 84 is as depicted in FIG. 5, a lower bracket assembly could easily be adapted to be secured to the bottom portion of roll towel dispenser 30 and to extend back into the recess 16 and be secured to the rear wall 22 of the recess 16.

While the present invention has been described with reference to a specific embodiment thereof, it would be obvious to those skilled in the art that various changes and modifications may be made without departing from the invention in its broader aspects.

What is claimed as new and desired to be secured by Letters Patent of the United States is:

1. Apparatus for mounting a roll towel dispenser on a door of a recessed paper towel cabinet so that the lower portion of the dispenser is mounted in front of a recess, said apparatus comprising a bracket plate having a hooked end portion adapted to fit over the top edge and contact a rear surface of the door of the recessed cabinet, said bracket plate being adapted to be secured to the rear of the dispenser cabinet and a lower support bracket adapted to be secured to at least one inner wall of the recess and to the roll towel dispenser thereby providing support for the lower portion of the roll towel dispenser.

2. Mounting apparatus as recited in claim 1 further comprising means for adhering the bracket plate to the front surface of the door of the recessed towel cabinet to stabilize the bracket.

3. Mounting apparatus as recited in claim 1 wherein the bracket plate adhering means is two-sided pressure sensitive adhesive tape.

4. Apparatus as recited in claim 2 wherein the securing means comprise bolts welded to the bracket and nuts for securing the rear wall of the roll towel dispenser to the mounting surface.

5. Apparatus for mounting a roll towel dispenser on a door of a recessed cabinet comprising:

(a) a unitary bracket having a hooked end portion adapted to fit over the top edge and contact a rear surface of the door of the recessed cabinet, the bracket having upper and lower sections adapted to brace against the front surface of the door of the recessed cabinet and a central section adapted to extend further from the front surface of the door than said upper and lower sections;

(b) means for securing the roll towel dispenser to the central section of the bracket; and (c) means for adhering a portion of the bracket to the front surface of the door to stabilize the bracket.

6. Apparatus as recited in claim 5 wherein the securing means comprise bolts welded to the central section of the bracket and nuts for securing the rear wall of the roll towel dispenser to the central section of the bracket.

7. Apparatus as recited in claims 5 or 6 wherein the means for adhering is two-sided pressure sensitive adhesive tape applied between the bracket and the door.

8. Mounting apparatus as recited in claims 5 or 6 wherein there is a recess beneath the door of the recessed cabinet and wherein the lower portion of the roll towel dispenser is to be mounted in front of said recess, said mounting apparatus further comprising a lower support bracket adapted to be secured to at least one inner wall of the recess and to the rear of the roll towel dispenser thereby providing support for the lower portion of the roll towel dispenser.

9. Mounting apparatus as recited in claims 5 or 6 wherein the bracket is not unitary, and wherein said central mounting section and the lower section of the bracket is adjustable to vary the height of the mounted roll towel dispenser.

* * * * *